US009896293B2

(12) United States Patent
Haapanen et al.

(10) Patent No.: US 9,896,293 B2
(45) Date of Patent: Feb. 20, 2018

(54) SLITTER-WINDER FOR WINDING OF PULP WEBS

(71) Applicants: Jaakko Haapanen, Järvenpää (FI); Marko Jorkama, Porvoo (FI); Arto Leskinen, Nukari (FI); Jari Pelkonen, Orimattila (FI)

(72) Inventors: Jaakko Haapanen, Järvenpää (FI); Marko Jorkama, Porvoo (FI); Arto Leskinen, Nukari (FI); Jari Pelkonen, Orimattila (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 157 days.

(21) Appl. No.: 14/934,035

(22) Filed: Nov. 5, 2015

(65) Prior Publication Data

US 2016/0130105 A1 May 12, 2016

(30) Foreign Application Priority Data

Nov. 6, 2014 (EP) ..... 14192051

(51) Int. Cl.
*B65H 18/16* (2006.01)
*B65H 18/02* (2006.01)
(Continued)

(52) U.S. Cl.
CPC ..... *B65H 18/16* (2013.01); *B65H 18/021* (2013.01); *B65H 18/025* (2013.01); *B65H 18/20* (2013.01); *B65H 18/26* (2013.01); *B65H 27/00* (2013.01); *B65H 35/02* (2013.01); *B65H 2301/41419* (2013.01); *B65H 2401/10* (2013.01); *B65H 2404/15* (2013.01); *B65H 2404/18* (2013.01); *B65H 2404/42* (2013.01); *B65H 2404/532* (2013.01); *B65H 2405/45* (2013.01);
(Continued)

(58) Field of Classification Search
CPC ..... B65H 18/16; B65H 18/20; B65H 18/26; B65H 18/021; B65H 18/025; B65H 27/00; B65H 35/02
See application file for complete search history.

(56) References Cited

U.S. PATENT DOCUMENTS 5,553,806 A 9/1996 Lucas
5,575,436 A 11/1996 McDermott
(Continued)

FOREIGN PATENT DOCUMENTS

DE 9420003 U1 4/1995
EP 0679595 11/1995
(Continued)

OTHER PUBLICATIONS

European Search Report for EP14192051 dated May 18, 2015.

*Primary Examiner* — Sang K Kim
(74) *Attorney, Agent, or Firm* — Stiennon & Stiennon

(57) ABSTRACT

A slitter-winder for winding of pulp webs or corresponding webs with a thickness of at least 0.5 mm, in which the winder is a two-drum winder having two winding drums on support of which at least two pulp web rolls are wound. At least one of the winding drums is a nip acceptance winding drum (NAWD), that is a winding drum with a cover having a hardness of 40-80 Shore A and a thickness of 3-50 mm. The winding drums and a steel core or a shaft of the at least two pulp web rolls have parallel rotation axes and are in a rolling contact where the at least one winding drum is driven.

6 Claims, 1 Drawing Sheet

(51) Int. Cl.

| | |
|---|---|
| ***B65H 18/20*** | (2006.01) |
| ***B65H 18/26*** | (2006.01) |
| ***B65H 27/00*** | (2006.01) |
| ***B65H 35/02*** | (2006.01) |

(52) U.S. Cl.
CPC .... *B65H 2408/232* (2013.01); *B65H 2511/13* (2013.01); *B65H 2515/81* (2013.01); *B65H 2801/84* (2013.01)

(56) References Cited

U.S. PATENT DOCUMENTS

| | | | |
|---|---|---|---|
| 5,582,361 | A | 12/1996 | Müller et al. |
| 5,853,139 | A | 12/1998 | Hehner et al. |
| 5,934,603 | A | 8/1999 | Cole et al. |
| 6,056,230 | A | 5/2000 | Peters et al. |
| 6,234,419 | B1 | 5/2001 | Hehner et al. |
| 7,458,539 | B2 | 12/2008 | Haven et al. |
| 2011/0240790 | A1 | 10/2011 | Kadota |
| 2012/0091248 | A1 | 4/2012 | Åkerlund et al. |

FOREIGN PATENT DOCUMENTS

| | | | |
|---|---|---|---|
| WO | 9728075 | A1 | 8/1997 |
| WO | 02079061 | A1 | 10/2002 |

SLITTER-WINDER FOR WINDING OF PULP WEBS

CROSS REFERENCES TO RELATED APPLICATIONS

This application claims priority on European Patent App. No. EP 14192051, filed Nov. 6, 2014, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a slitter-winder for winding of pulp webs, and more particularly to a slitter-winder for winding of pulp webs and corresponding thick webs having two drums for supporting at least two web rolls.

The pulp web is made in a cellulose drying production line, wherein the production line comprises the cellulose drying machine and equipment for performing further treatment on the dried cellulose web. Density of the pulp web is about 400-800 kg/m$^3$ and thickness of the pulp web is about 0.5-2.5 mm.

In manufacturing lines known from the prior art pulp web making takes place as a continuous process. A pulp web completing in a machine is wound with a reel-up around a reeling shaft, i.e. reel spool, into a machine roll (a parent roll). The purpose of reeling is to modify the web manufactured as planar into a more easily processable form. In the reel-up the continuous process of the machine breaks for the first time and shifts into periodic operation. This periodicity is tried to be made as efficiently as possible in order to avoid waste of already completed work in earlier process stages.

The pulp web wound onto the machine roll is full-width so it must be slit into partial webs with a suitable width. The partial webs are wound to partial web rolls (customer rolls) of suitable length or of suitable diameter for the customers. The slitting and winding take place as known from the prior art in an appropriate separate machine, i.e. in a slitter-winder.

As known from the prior art, in the slitter-winder the machine roll is unwound, and the wide web is slit on the slitting section into several narrower partial webs which are wound up on the winding section around winding cores or around winding shafts or around winding cores located on the shafts, such as spools, into customer rolls. When the customer rolls are completed, the slitter-winder is stopped and the rolls, i.e. the so-called set, is removed from the machine after which the process is continued with the winding of a new set. These stages are repeated periodically until the web runs out of the machine roll, at which point a machine roll change is performed and the operation starts again as the unwinding of a new machine roll. When producing customer rolls of pulp web grades a set of customer rolls of desired diameter is rapidly formed. Once the customer rolls are formed new winding cores/a new winding shaft with or without winding cores must be placed in the winder for the beginning of winding of the next set of customer rolls and the end of each partial pulp web must be lead and attached to the winding core.

Slitter-winders employ winding devices of different types, for example winders and two-drum winders. In the two-drum winders the partial webs are wound around winding cores supported by two winding drums to partial web rolls via a nip between the winding drums and the partial pulp web rolls being formed. In the two-drum winders also a belt arrangement i.e. a so-called set of belt rolls with belt loop or belt loops located around two guide rolls can be used as the winding drum. As known in the prior art, winding with a shaft without cores or together with cores can be employed in the winding of a pulp web into customer rolls on a slitter-winder.

The present invention relates to two drum winders with two winding drums.

Typically in winding of pulp webs only two-drum winders have been used. In the winder the winding drums have been hard roll shells of steel or cast iron and in some cases with a thin hard coating of carbides, typically of tungsten carbides.

One problem that exists when a pulp web is wound with a two-drum winder is that the winding nip formed between the pulp web roll and the winding drums does not function well at the beginning of the winding. The non-functioning winding nip means on the one hand that the tail of the web is difficult to thread into the winding nip and on the other hand that the nip pressure does not provide enough traction to the pulp web and thus the winding of especially the first layers is non-uniform and leads to poor winding on the bottom of the roll. This is partly caused by the fact that use of a heavy rider roll load, which would help the functioning of the winding at the beginning, is not possible, since a heavy rider roll load would easily lead to breaks in the pulp web. Neither is web tension a proper winding parameter in winding of pulp webs, since high tension values are needed in order to stretch the pulp web, but too high web tension easily breaks the pulp web, which typically is not homogeneous. The high tension may also cause sliding of the pulp roll in the winding nip against the winding drums.

Due to the drying process of the pulp the pulp web is not homogenous and in pulp winders some of the partial webs remain loose, in particular at the beginning of the winding due to the reason that it is not possible to stretch the non-homogenous partial pulp webs sufficiently by the available web tension in order to achieve sufficient tension in all partial pulp webs.

Furthermore, the nip induced addition to the web tension is negligible, since the pulp roll is in the beginning too hard due to the hard core or shaft to allow the nip induced mechanism to work. After several layers have been wound around the winding shaft or core the nip induced tension mechanism starts to work as the pulp rolls become capable of deforming substantially in the radial direction. Finally all the partial webs reach a sufficient level of web tension, since the nip induced tension becomes higher for the pulp rolls corresponding to looser partial webs due to the larger radial deformations of these softer rolls.

Due to the non-homogenous web and the non-functioning winding nip at the near beginning of the winding the bottom of the wound roll tends to be loose, which easily leads to shifted layers in the wound pulp roll. In the worst cases there happens a phenomenon called nip rejection, where a loose bag in the pulp web forms in front of the nip. The nip rejection usually leads to a pulp web break.

The prior art of slitter-winders for paper and board winding includes winding drums having elastomeric covers. Earlier the practice was to construct these covers with a hardness of 85 Shore "A" (ShA), or greater, but nowadays also covers with a hardness as soft as 65 Shore "A" (ShA) are used. On the Shore "A" (ShA) scale, readings approaching 100 are relatively hard, and readings approaching 25 are relatively soft. If the elastomeric cover is made quite hard, such as having a hardness of about 95 Shore "A" (ShA), or harder, then its operational characteristics are relatively similar to those of a steel drum. That is, the nip area is quite narrow, even approaching line contact, which provides neither a relatively large, nor soft, nip contact.

In U.S. Pat. No. 7,458,539 is described a winder roll starting apparatus for thick webs. In US patent application publication 2012/0091248 is described a method and apparatus for threading a fibrous material web in a winder. These prior art publications relate thus to the problem of threading of the web and not to the problems of beginning of winding i.e. to the winding of a few first layers of the pulp web after the pulp web has been threaded nor to the problems of functioning of the winding nip during winding of the early layers of the pulp web.

It is known from slitter-winders for paper or board winding to use as a winding drum a roll with soft cover. For example in EP patent publication 0679595 is disclosed a winding roll with an elastomeric cover which has a hardness between 65 and 80 Shore A, for increasing production speed and providing careful winding such that surface faults of the paper or board web or winding faults of the paper or board roll to be wound are avoided. In EP patent publication 0879199 is disclosed a roll for a winder with a deformable layer with the compression modulus less than 10 MPa for providing winding without winding faults in the wound paper of the board roll. In U.S. Pat. No. 6,234,419 is disclosed a winding-up process and machine for winding paper or board webs in which a winding roll with a volume compressible outer layer with a compression modulus lower than 10 MPa for winding of fiber webs that have grammage of less g/m$^2$ with high quality and high speed. In U.S. Pat. No. 5,553,806 is disclosed a support or rider roll for a paper roll winder in which the roll has an outer elastomeric cover with pattern, open to surface arranged such that the effective hardness of the cover ranges between 30 and 55 Shore A for providing a softer and wider nip with a long service life. In addition, in U.S. Pat. No. 5,575,436 is disclosed a winder for webs in which a drum with a covering layer with an outer surface pattern providing a series of recesses and land areas is provided for high speed winding to reduce noise and to reduce winding nip induced tension. The prior art relating to winders for paper or board, in which a winding roll with a soft cover is used, does not teach anything relating to the above discussed problems at the beginning of winding of pulp webs in a slitter winder nor do they give any hint to solving the above discussed problems as these problems are due to the characteristics of pulp webs, which are typically much more non-homogenous than paper or board webs, and these problems do not occur in paper or board winding.

SUMMARY OF THE INVENTION

An object of the present invention is to create a slitter-winder for winding of pulp webs in which especially the problems at the beginning of the winding are eliminated or at least minimized.

An object of the present invention is to provide for an improved slitter winder for winding of pulp webs.

The invention especially relates to a slitter-winder for winding of pulp webs and corresponding thick webs, the thickness of which is at least 0.5 mm.

According to the invention in the slitter-winder for winding of pulp webs or corresponding webs, the thickness of which is at least 0.5 mm, the winder is a two-drum winder comprising two winding drums on the support of which at least two pulp web rolls are wound and at least one of the winding drums is a nip acceptance winding drum (NAWD), that is a winding drum with a cover having a hardness of 40-80 Shore A and a thickness of 3-50 mm, and the winding drum and steel core or shaft of the at least two pulp web rolls have parallel rotation axes and are in rolling contact where the at least one winding drum is driven.

According to the invention the hardness of the cover of the NAWD is 40-80 Shore A. The soft cover strains in the machine direction, i.e. in a tangential direction significantly even at low nip load values.

According to the invention the thickness of the cover of the NAWD is 3-50 mm.

According to an advantageous feature of the present invention the slitter winder for winding pulp webs comprises two winding drums and at least one of the winding drums is a soft covered NAWD. In order to ensure practically high enough positive tangential strain of the winding drum cover in the winding nip it would be advantageous that the cover elastic modulus is of the same magnitude as the radial elastic modulus of the wound roll, i.e., the radial deformation of the soft cover is at least 10% of the radial deformation of the wound roll.

When at least one of the winding drums is the NAWD and when the cover elastic modulus is of the same magnitude as the elastic modulus of the wound roll the strain of the cover causes also a significant strain in the pulp web and thus it is possible to create higher web tension to the winding nip ingoing pulp web even at low nip load values. Simultaneously a remarkably better functioning winding nip is achieved.

According to an advantageous feature at least the winding drum along the surface of which the pulp web is guided to the winding is the NAWD.

According to another advantageous feature of the invention both winding drums are NAWDs with soft cover elastic modulus of the same magnitude as the radial elastic modulus of the wound roll.

According to another advantageous embodiment of the invention the NAWD is plain, i.e. without grooves or bores.

Advantageously the material of the cover of the soft covered winding drum is elastomeric polymeric material for example polyurethane, natural rubber, synthetic rubbers such as neoprene, styrene-butadiene (SBR), nitrile rubber, chlorosulfonated polyethylene, and EDPM.

In the following the invention will be described in more detail with reference to the figures in the accompanying drawings, the invention being however not supposed to be in any way strictly confined to the details of said illustrations.

DESCRIPTION OF THE PREFERRED EMBODIMENTS

Figure 1:
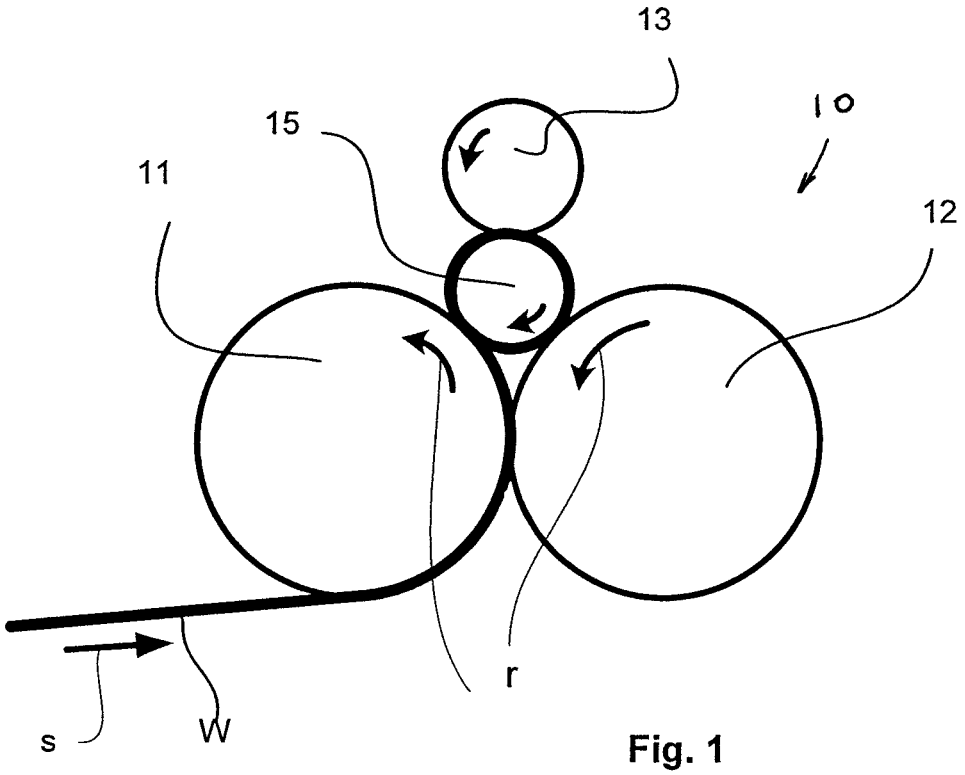
FIG. 1 is a schematic illustration of a two-drum winder according to an advantageous embodiment of the invention.
Figure 2:
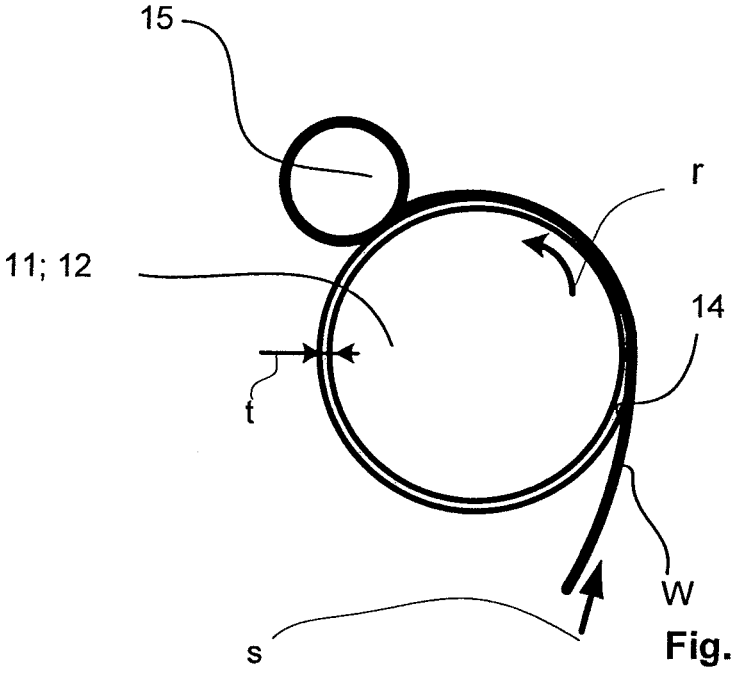
FIG. 2 is a schematic illustration of a winding drum according to one advantageous feature of the invention.

In FIGS. 1 and 2 the same reference signs are used for the same or respective components, part assemblies etc. unless otherwise stated. Some reference signs have been omitted from some of the figures for the sake of clarity.

The winder 10 shown in FIG. 1 is a two-drum winder which comprises two winding drums 11, 12 and a rider roll 13. In the winder at least two longitudinally successive pulp web rolls 15 to be wound are supported by the winding drums 11, 12 from below and by a rider roll 13 from above the pulp web rolls 15. In two-drum winders one of the winding drums can be a set of belt rolls in which an endless loop/loops of belt/belts is/are arranged around two guide rolls depending on the type of two-drum winder. In a slitting section (not shown) preceding the winder the pulp web is slit longitudinally into parallel partial webs W which are wound in the winder to a set of successive partial pulp web rolls 15. By the arrows r in the figure are shown the direction of rotation of the corresponding drum and the running direction of the web W is indicated by arrows s. The winding nips are formed between the pulp web rolls 15 to be wound and the winding drums 12.

One or both of the winding drums 11, 12 are NAWD drums. The NAWD drum is the front 12 or back 11 winding drum or both front 12 and back 11 winding drums are NAWD drums.

In FIG. 2 is shown a winding drum 11; 12 that is NAWD, which is soft covered provided by a soft cover 14. The hardness of the cover 14 of the soft covered NAWD 11; 12 is advantageously 40-85 Shore A. The NAWD 11; 12 is advantageously plain i.e. without grooves or bores. The material of the cover of the NAWD is elastomeric polymeric material for example polyurethane, natural rubber, synthetic rubbers such as neoprene, styrene-butadiene (SBR), nitrite rubber, chlorosulfonated polyethylene, or EDPM. The thickness t of the cover 14 of the NAWD 11;12 is 3-50 mm.

We claim:

1. A winder for winding of pulp webs after a slitter comprising:

a plurality of pulp rolls each pulp roll having a density of 400-600 kg/m$^3$ and is formed of a web of 1.5-2.5 mm thickness;

a two-drum winder comprising two winding drums positioned to support at least two pulp web rolls, the two-drum winder having a first drum with a first drum surface, wherein each pulp roll is wrapped by the pulp web which first wraps a portion of the first drum surface and is guided through a first nip at the first drum of the two-drum winder which is a nip acceptance winding drum (NAWD) having a cover with a hardness of 40-80 Shore A, a thickness of 3-50 mm, wherein the at least two winding drums are rotatable about parallel rotation axes; and wherein the pulp web rolls are wound about cores or shafts which are parallel to the winding drum rotation axes, the pulp web rolls being supported in driven rolling contact to be driven by at least the winding drum which is driven.

2. The winder of claim 1 wherein the NAWD is a plain roll without grooves or bores.

3. The winder of claim 1 wherein the material of the cover of the NAWD is elastomeric polymeric material.

4. The winder of claim 1, wherein the winder further comprises a rider roll disposed to press the pulp web rolls to be wound and transmitting torque.

5. The winder of claim 1, wherein the cover with the hardness of 40-80 Shore A has a thickness of 10-50 mm.

6. A method of forming and winding a multiplicity of pulp webs comprising the steps of:

slitting in the machine direction a pulp web having a density of 400-600 kg/m$^3$ and thickness of 1.5-2.5 mm to form a plurality of web pulp webs;

passing each of the plurality of pulps webs in a machine direction along a surface of a first drum of a two-drum winder, wherein the first drum surface is a drum cover with a hardness of 40-80 Shore A and a thickness of 10-50 mm, and wherein the first drum defines a radial direction perpendicular to the drum cover;

forming from each of the plurality of web pulp webs a pulp roll about a core or shaft supported between the first drum and a second drum of the two drum winder so that each of the plurality of pulp webs passes though a nip formed between said core or shaft and the drum cover;

wherein at least one of the first drum and the second drum of the two drum winder is driven to cause the winding of the pulp webs.

* * * * *